United States Patent [19]

Carrier

[11] Patent Number: 4,470,517

[45] Date of Patent: Sep. 11, 1984

[54] HINGE ASSEMBLY

[75] Inventor: John A. Carrier, Chilwell, England

[73] Assignee: Plessey Overseas Limited, Ilford, England

[21] Appl. No.: 535,274

[22] Filed: Sep. 23, 1983

[30] Foreign Application Priority Data

Sep. 27, 1982 [GB] United Kingdom ..... 8227534

[51] Int. Cl.[3] ..... B65D 43/14; B65D 51/04

[52] U.S. Cl. ..... 220/341; 220/337

[58] Field of Search ..... 220/337, 338, 340, 341

[56] References Cited

U.S. PATENT DOCUMENTS 4,307,819 12/1981 Araki ..... 220/241

4,349,121 9/1982 Lafferty ..... 220/341

*Primary Examiner*—George T. Hall

*Attorney, Agent, or Firm*—Fleit, Jacobson, Cohn & Price

[57] ABSTRACT

A hinge assembly for a lid for a container consists of a pivot pin secured to the lid and which is rotatably mounted at its end in recesses formed inside the container. The pivot pin is retained in the recesses by an abutment member formed inside the container, the abutment member being deflectable to permit the pivot pin to be inserted into or withdrawn from the recesses. The abutment member is moulded as part of the container and is shaped so that no movable cores are required for the moulding tool resulting in a low cost arrangement.

6 Claims, 3 Drawing Figures

HINGE ASSEMBLY

This invention relates to hinge assemblies for two relatively movable parts such as, for example the lid of a container.

It is sometimes desirable to be able to easily remove and replace the lid and it is an object therefore of the present invention to provide a hinge assembly which is readily assembled and dismantled and which is low in cost.

Figure 1:
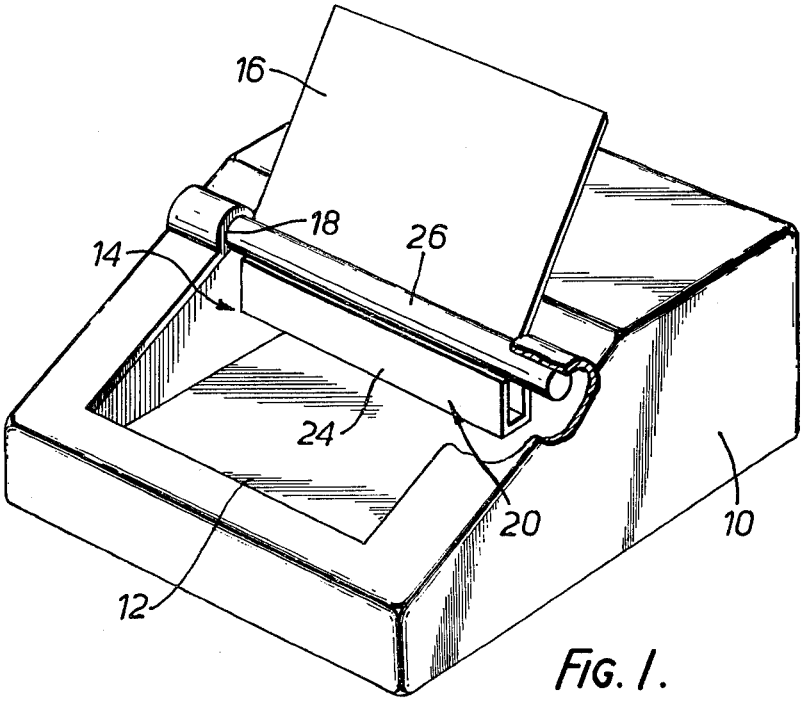
Figure 2:
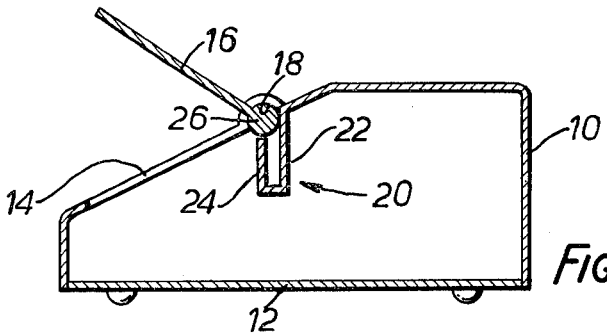
Figure 3:
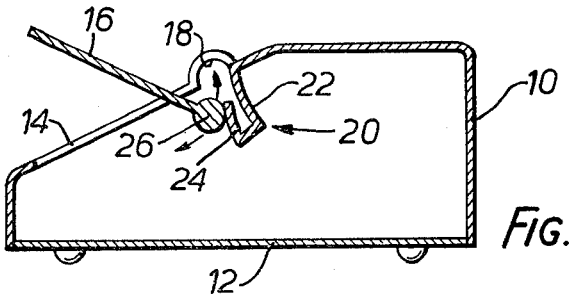

According to an aspect of the present invention a hinge assembly for two relatively movable first and second parts comprises a pivot member formed on the first part which is rotatably mounted in a recess formed in the second part, the pivot member being retained in the recess by an abutment member formed on the second part, the abutment member being flexible whereby it can be moved to a position in which the pivot member can be removed from or inserted into the recess. An embodiment of the invention will now be described by way of example only with reference to the accompanying drawings in which, FIG. 1 illustrates a container with a lid having a hinge assembly in accordance with the present invention, FIG. 2 is a cross sectional view through the container of FIG. 1 and, FIG. 3 is a similar cross-sectional view showing the method of removing or fitting the lid. The container consists of a housing 10 made of moulded plastic material which is supported by any suitable means on a base 12. An opening 14 is formed in the upper portion for receiving the lid 16, there being formed each side of the opening 14 inside the housing 10 a substantially semicircular recess 18. Also formed inside the housing is an abutment member 20 which has a U-shaped cross-sectional shape and extends across the complete width of the opening 14. The abutment member 20 is formed integrally with the housing, one side 22 extending from the housing 10 along the edge of the opening 14 and the other side 24 terminating close to a line connecting the centres of the semi-circular recesses 18. Since the abutment member 20 is formed out of plastics material it has a degree of flexibility and the sides 22 and 24 can be deflected as shown in FIG. 3. By forming the sides 22 and 24 of the abutment member 20 substantially vertical, i.e. substantially parallel to the walls of the housing 10, and with the side 22 forming the edge of the opening 14, as shown in FIG. 2, there is nothing to prevent a straight withdrawal of the internal moulding tool after mounting and no additional removable portions are required on the mould. All other sides and edges such as the edges of the opening 14 and the recesses 18 are also substantially parallel to the sides of the housing 10 to permit the straight withdrawal of the moulding tool. The lid 16 is also made of plastics material and is formed integrally with a circular pivot pin 26 located at one end of the lid. The ends of the pivot pin 26 project beyond the width of the lid and are adapted to fit into the recesses 18 whereby the lid is pivotable on the housing 10. The pivot pin is held in this position by the side 24 of the abutment member 20 which contacts the pivot pin 26 and urges it into the recesses 18. To insert the lid into position, the sides 22 and 24 are deflected, as shown in FIG. 3, and the ends of the pivot pin 26 are located in the recesses 18 from inside the housing 10. Removal of the lid can be achieved by similarly deflecting the sides 22 and 24 to permit the pivot pin 26 to be removed from the recesses 18.

It is intended that the housing 10 is made from a fairly rigid plastics material, such as A.B.S., and the U-shape of the abutment member 20 provides sufficient length to obtain the required degree of flexibility of the member 20 in a small space.

Thus the housing is reasonably strong and the use of a single internal moulding tool with no movable parts results in a minimum cost for the container.

I claim:

1. A hinge assembly for relatively movable first and second parts comprising a pivot member on the first part and a recess in the second part, the pivot member being rotatably mounted in the recess and retained therein by an abutment member on the second part, which abuts the pivot member when the pivot member is in the recess, the abutment member being flexible whereby it can be moved to a position where it does not abut the pivot member and the pivot member can be removed from or inserted into the recess.

2. A hinge assembly as claimed in claim 1 in which an opening is formed in the second part and a recess is formed on each of two opposite sides of the opening, the recesses being in alignment.

3. A hinge assembly as claimed in claim 2 in which the first part has a similar shape to the opening and fits closely within the opening, the pivot member extending beyond opposite sides of the first part to fit within the recesses in the second part.

4. A hinge assembly as claimed in claim 2 in which the abutment member comprises a flange with a U-shaped cross-section extending across the opening, the first side of the flange extending from the second part adjacent to the edge of the opening and the second side being normally aligned with the recesses and abuting the pivot member, the flange being flexible whereby the second side can be urged to a position where it does not abut the pivot member.

5. A hinge assembly as claimed in claim 1 in which the second part comprises a container housing and the second part comprises a lid for the container.

6. A hinge assembly as claimed in claim 5 in which the container housing has rectangular opening there being formed each side of the opening in the interior of the housing a substantially semi-circular recess, the recesses being in axial alignment and adjacent to a third side of the opening, an elongate flange having a U-shaped cross-section, one side of the flange extending from the entire length of the third side of the opening into the interior of the housing, the second side of the flange being normally in alignment with the semicircular recesses but being displacable to a position in which it is out of alignment with the semicircular recesses, the lid being rectangular in shape and fitting closely within the rectangular opening in the housing, a circular pivot member extending along one side of the lid and projecting from the ends of that side, the projecting portions of the pivot member being rotatable in the semicircular recesses in the housing and being retained in position by the second side of the elongate flange in the interior of the housing, the pivot member being removable from the semicircular recesses and hence the lid being removable when the second side of the elongate flange is displaced out of alignment with the pivot member.

* * * * *